United States Patent [19]

Ishii et al.

[11] 4,194,594

[45] Mar. 25, 1980

[54] ELEVATOR LANDING CONTROL APPARATUS

[75] Inventors: Toshiaki Ishii; Eiki Watanabe, both of Inazawa, Japan

[73] Assignee: Mitsubishi Denki Kabushiki Kaisha, Tokyo, Japan

[21] Appl. No.: 889,113

[22] Filed: Mar. 22, 1978

[30] Foreign Application Priority Data

Mar. 31, 1977 [JP] Japan ..... 52-36499

[51] Int. Cl.[2] ..... B66B 1/40

[52] U.S. Cl. ..... 187/29 R

[58] Field of Search ..... 187/29

[56] References Cited

U.S. PATENT DOCUMENTS

| | | | |
|---|---|---|---|
| 2,847,091 | 8/1958 | Santini et al. | 187/29 |
| 3,207,265 | 9/1965 | Lund et al. | 187/29 |
| 3,815,711 | 6/1974 | Hoelscher | 187/29 |
| 3,983,961 | 10/1976 | Aron | 187/29 |

OTHER PUBLICATIONS

"Speed Control of High Speed (1800 ft/min) Elevator" (YP 4706), IEEE Conference Paper C75 118-5, Nov. 1974.

*Primary Examiner*—B. Dobeck
*Assistant Examiner*—W. E. Duncanson, Jr.
*Attorney, Agent, or Firm*—Oblon, Fisher, Spivak, McClelland & Maier

[57] ABSTRACT

An elevator landing control apparatus comprises a cage and a counter-weight which are suspended by a main rope in a hoistway; a winding motor which drives a driving sheave; a brake for holding the cage by holding the motor during the stop of the cage; a landing device or a cage acceleration control circuit; a lower floor detecting circuit and a door open detecting circuit and a control circuit which releases the holding of the motor by the brake and actuates the landing device or the cage acceleration circuit when the lower floor detecting circuit and the door open detecting circuit are in the actuated condition.

2 Claims, 6 Drawing Figures

ELEVATOR LANDING CONTROL APPARATUS

BACKGROUND OF THE INVENTION

1. Field of the Invention

The present invention relates to an improvement of an apparatus for controlling a cage of an elevator at the landing.

2. Description of Prior Art

In an elevator for high travelling height equipped in a high building or super-high building, a main rope for suspending a cage is remarkably long. Accordingly, when the cage is at a lower floor the main rope is elongated and contracted by the riding or the leaving of a passenger to vertically swing the cage even though the winding motor is held by a brake.

As the result, the passengers feel uneasy.

SUMMARY OF THE INVENTION

It is an object of the present invention to provide an elevator landing control apparatus which can reduce the vertical swinging of the cage caused by the riding and the leaving of a passenger and eliminate the uneasy feeling of the passengers.

The foregoing and other objects of the present invention have been attained by providing an elevator landing control apparatus which comprises a cage and a counter-weight which are suspended by a main rope in a hoistway; a winding motor which drives a driving sheave; a brake for holding the cage by holding the motor during the stop of the cage; a landing device or a cage acceleration control circuit which produces the torque for holding the cage by the motor when the cage is at the stopping lower floor; a lower floor detecting circuit and a door open detecting circuit and a control circuit which releases the holding of the motor by the brake and actuates the landing device or the cage acceleration circuit when the lower floor detecting circuit and the door open detecting circuit are in the actuated condition.

DETAILED DESCRIPTION OF THE PREFERRED EMBODIMENTS

Referring to FIGS. 1 to 4, one embodiment of the present invention will be illustrated.

Figure 1:
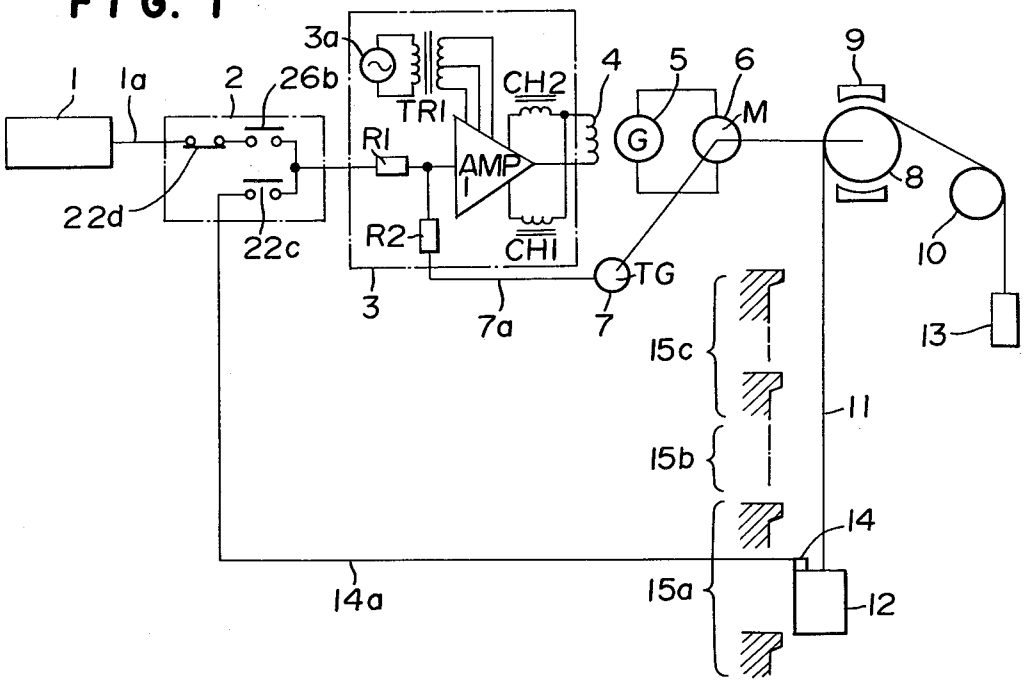
FIG. 1 is a diagram of one embodiment of an elevator landing control apparatus according to the present invention.
Figure 2:
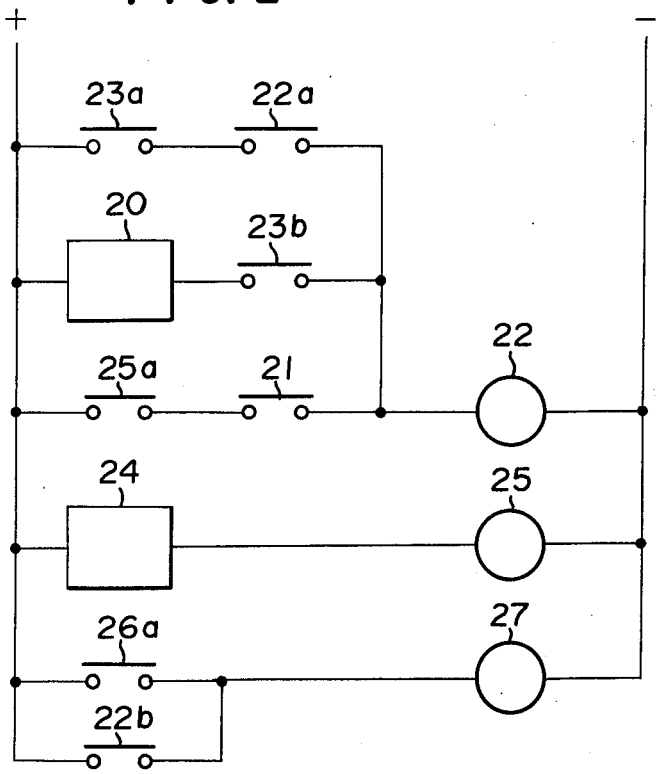
FIG. 2 is a control circuit diagram.
Figure 4:
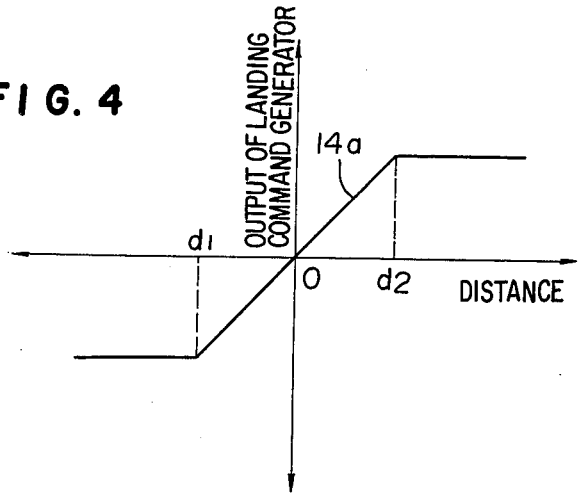
FIG. 4 is an output characteristic curve of a landing command generator.

In FIGS. 1 and 2, the reference numeral (1) designates a speed command generator such as the selector, the transducer and the acceleration device shown in FIG. 4A in U.S. Pat. No. 3,207,265 and (1*a*) designates an output thereof; (2) designates a switch circuit; (3) designates a field current control device; (3*a*) designates an AC power source; ($R_1$) and ($R_2$) designates resistors; ($TR_1$) designates a transformer; ($CH_1$) and ($CH_2$) designates choking coils; ($AMP_1$) designates an amplifier using SCR; (4) designates a generator field coil; (5) designates a generator armature; (6) designates a motor armature to which a DC power is fed from the armature (5); (7) designates a generator for speed indicator; (7*a*) designates an output thereof; (8) designates a driving sheave driven by the armature (6); (9) designates a friction brake for braking the armature (6) i.e. the driving sheave (8); (10) designates a deflector sheave; (11) designates a main rope wound on the driving sheave (8) and the deflector sheave (10); (12) designates a cage; (13) designates a counter-weight; (14) designates a landing command generator which is disposed in the cage and generates the landing command shown in FIG. 4 by electromagnetic coupling with an inductor plate (not shown) disposed in a hoistway such as the hoistway transducer shown in FIG. 4A of U.S. Pat. No. 3,207,265; (14*a*)designates the output of the landing command generator; (15*a*) designates a lower floor of a building; (15*b*) designates a middle floor; (15*c*) designates an upper floor; (+), (−) designates a DC power source; (20) designates a door openable zone detecting circuit which is closed by travelling the cage (12) in each door openable zone for each floor (about 250 mm from the floor level in upper and lower direction); (21) designates a door opening detecting relay contact which closes in the case of door opening and opens in the case of door closing; (22) designates a speed command relay; (22*a*)–(22*c*) designates normally opened contacts and (22*d*) designates a normally contact; (23*a*) and (23*b*) designate a deceleration selecting relay contact which is closed by the reaching of the cage (12) to the predetermined distance from the landing floor level and is opened by the stopping of the cage; (24) designates a lower floor detecting circuit which closes when the cage (12) is at the lower floor (15*a*); (25) designates a lower floor detecting relay; (25*a*) designates a normally opened contact; (26*a*) and (26*b*) designates travel command relay contacts which close by the travel command and open after the stopping of the cage; (27) designates a brake coil which releases the armature by inactuating the brake (9) in the case of excitation and holds the armature by actuating the brake (9) in the case of non-excitation.

The operation of the embodiment will be illustrated.

Figure 3:
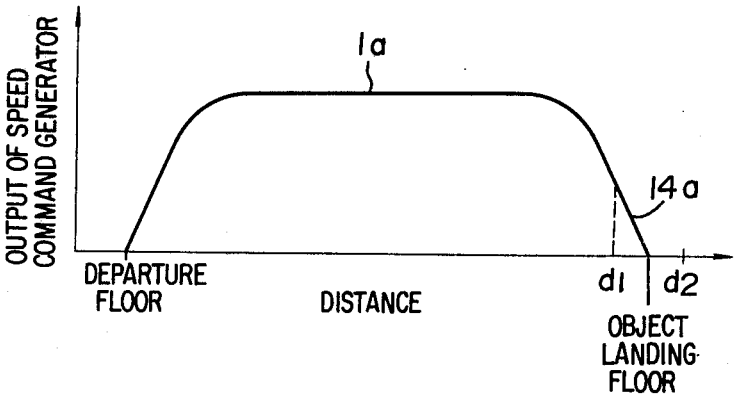
FIG. 3 is an output characteristic curve of a speed command generator.

The speed command generator (1) generates the output (1*a*) shown in FIG. 3. At the start of the cage (12), the deceleration selecting relay contacts (23*a*), (23*b*) are in OFF state and the door opening detecting relay contact (21) is in OFF state because of closing of the door. Accordingly, the speed command relay (22) is inactuated whereby the contact (22*d*) is in ON state and the contact (22*c*) is in OFF state. When the cage (12) is not at the lower floor (15*a*), the lower floor detecting circuit (24) is in OFF state and the lower floor detecting relay (25) is inactuated and the contact (25*a*) is in OFF state.

Both of the travel command relay contact (26*a*) and the speed command relay contact (22*b*) are in OFF state whereby the brake coil (27) is non-excited and the armature (6) is held by the brake (9).

When the travel command is given to close the travel command relay contact (26*b*), the output (1*a*) of the speed command generator is input through the circuit of (22*d*)–(26*b*) to the field current control device (3). On the other hand, the contact (26*a*) is closed and the brake coil (27) is excited to release the armature (6). The control device (3) compares the output (1*a*) with the output (7*a*) of the generator for speed indicator and the generator field coil (4) is excited by the deviation signal and the speed of the armature (6) is automatically held by the known Ward-Leonard control device to control the speed of the cage (12).

When the cage (12) reaches to the predetermined distance from the object landing floor, the deceleration selecting relay contacts (23*a*), (23*b*) are closed. When the cage (12) further approaches to the object landing floor to reach the end ($d_1$) of the door openable zone, the door openable zone detecting circuit (20) is closed. The door open detecting relay contact (21) is closed since the door starts to open at this time, i.e., at $d_1$, corresponding to approximately 250 mm from the floor level. The speed command relay (22) is actuated by the circuit of (+)-(20)-(23*b*)-(22)-(−) and it is self-sustained by closing the contact (22*a*) and at the same time, the contact (22*b*) is closed. The contact (22*d*) is opened and the contact (22*c*) is closed whereby the speed command is switched from the speed command generator (1) to the landing command generator (14). The landing command generator (14) generates the output (14*a*) shown in FIG. 4. In FIG. 4, the reference 0 designates the object floor and the output (14*a*) correspond at a ratio of 1 to 1 to the distance to the object floor in the door openable zone $d_1$, $d_2$. The speed of the armature (6) is controlled depending upon the output (14*a*) and the cage (12) is decelerated to stop at the object floor.

When the cage (12) is stopped, the contacts (23*a*), (23*b*) are opened to inactuate the speed command relay (22) and the contact (22*b*) is opened and at the same time, the contact (26*a*) is opened whereby the brake coil (27) is non-excited to hold the armature (6).

When the cage (12) is landed at the lower floor, the lower floor detecting circuit (24) is closed and the lower floor detecting relay (25) is actuated to close the contact (25*a*). The cage (12) is in the door zone and the door is in the open state, and the contact of the door open detecting relay contact (21) is closed whereby the speed commend relay (22) is maintained actuated by the circuit of (+)-(25*a*)-(21)-(22)-(−) until the door is closed at the next start. Therefore, the brake coil (27) is maintained excited through the contact (22*b*) even after the landing, and the armature (6) is maintained released from the brake and the cage (12) is electrically held by the output (14*a*) of the landing command generator input through the speed command relay contact (22*c*) to the excitation current control device (3). That is, the output (14*a*) is automatically controlled to be zero when the cage (12) is upwardly or downwardly swing to the floor depending upon the riding and leaving of passengers whereby the level of the cage floor is kept on the same level as the landing floor. As the result, the cage (12) is not substantially moved in the vertical direction.

When the door is closed for starting the cage (12), the contact (21) is opened to inactuate the speed command relay (22).

When the door of the cage (12) is closed or the cage (12) is at the middle floor (15*b*) or the upper floor (15*c*), the speed command relay (22) is not actuated whereby the electrical holding is not performed, because the riding or leaving of passengers does not result and the stress of the main rope (11) does not result when the door is closed.

When the cage (12) is at the middle floor (15*b*) or the upper floor (15*c*), the length from the main rope (11) of the driving sheave (8) is shorter whereby the vertical swing of the cage (12) is not serious problem. It is not preferable to electrically hold the cage (12) in such states because of increase of the heating of the generator and the motor.

In said embodiment, the condition of the electrical holding of the cage is limited whereby the heating of the generator and the motor can be reduced.

Figure 5:
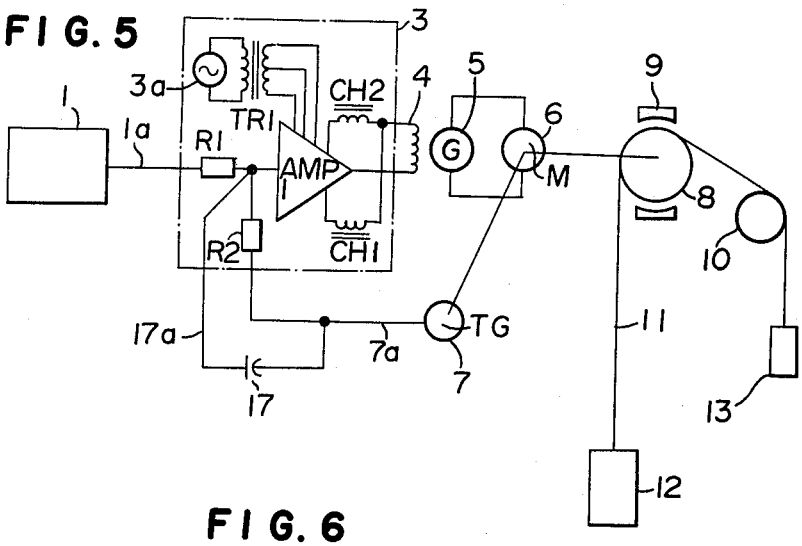
FIG. 5 is a diagram of the other embodiment corresponding to FIG. 1 according to the present invention.
Figure 6:
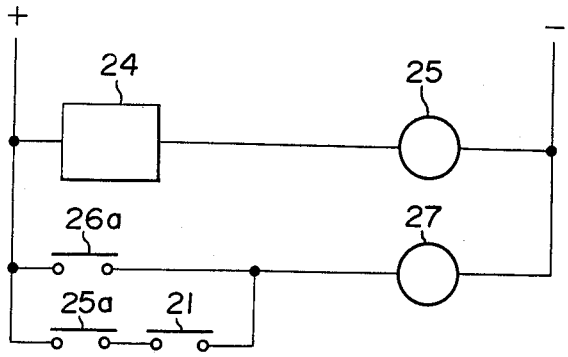
FIG. 6 is a control circuit diagram corresponding to FIG. 2.

FIGS. 5 and 6 show the other embodiment of the present invention. In FIGS. 5 and 6, the reference (17) designates a differential circuit which differentiates the output (7*a*) of the generator for speed indicator (7) and (17*a* ) designates an output thereof.

In the embodiment, the switch circuit (2) and the landing command generator (14) shown in FIG. 1 are not used.

As it is clear from the drawings, the output (17*a*) of the differential circuit (17) corresponds to the acceleration of the cage (12). That is, the acceleration control circuit of the cage (12) is used. When the door is in the open condition, the contacts (25*a*), (21) are closed and the brake coil (27) is actuated and the armature (6) is released. The cage (12) is controlled by the acceleration control circuit whereby the vertical swing of the cage (12) is controlled. Accordingly, in this embodiment, the landing command generator (14) shown in FIG. 1 need not be used.

In these embodiments, it is easy to eliminate the electrical holding of the cage when the temperature of the generator or the motor is over the predetermined temperature in order to control the heating of the generator and the motor.

As described above, in the present invention, when the cage is at the lower floor and the door is in the open condition, the brake is released to generate the torque for holding the cage in the generator by the landing device.

When the brake is released, the motor is controlled by the accelerator control circuit.

In accordance with the present invention, the vertical swing of the cage caused by riding and leaving passengers is reduced to eliminate uneasy feeling of passengers.

What is claimed is:

1. In an elevator system for a building having upper and lower floors, said system including a cage connected to one end of a main rope and a counter-weight connected to the other end of the main rope in a suspended condition for vertical travel in a hoistway, a winding motor which drives a driving sheave on which the main rope is wound so as to produce vertical travel of the cage and the counter-weight, a brake for holding the cage by holding the motor during stopping of the cage, and a landing device which controls the motor to generate an output for forming the torque required for holding the cage by the motor when the cage is at a stopping floor, an improved elevator landing control apparatus comprising:

a lower floor detecting circuit which detects the presence of the cage at a lower floor and is actuated thereby;

a door open detecting circuit which detects the opening of the door of the cage and is actuated thereby; and a control circuit which actuates the landing device without the holding of the motor by the brake only when the lower floor detecting circuit and the door open detecting circuit are in the actuated condition.

2. An elevator landing control apparatus according to claim 1 wherein the landing device comprises:

an inductor plate disposed in said hoistway; and a landing command generator disposed in the cage to generate the landing command signal by electromagnetic coupling with said inductor plate.

* * * * *